US006160978A

United States Patent [19]

Tsuruoka et al.

[11] Patent Number: 6,160,978

[45] Date of Patent: Dec. 12, 2000

[54] IMAGE FORMING APPARATUS HAVING AN ENDLESS BELT PROVIDED WITH RIBS AND INDICIA

[75] Inventors: Ryouichi Tsuruoka; Iwao Kuriki; Norio Ogawahara, all of Saitama, Japan

[73] Assignee: Fuji Xerox Co., LTD, Tokyo, Japan

[21] Appl. No.: 09/244,131

[22] Filed: Feb. 4, 1999

[30] Foreign Application Priority Data

| | | | |
|---|---|---|---|
| Feb. 5, 1998 | [JP] | Japan | 10-039617 |
| Feb. 5, 1998 | [JP] | Japan | 10-039623 |
| Feb. 5, 1998 | [JP] | Japan | 10-039624 |

[51] Int. Cl.[7] ..... G03G 15/00

[52] U.S. Cl. ..... 399/165; 399/302

[58] Field of Search ..... 399/162–165, 399/301, 302

[56] References Cited

U.S. PATENT DOCUMENTS

| | | | |
|---|---|---|---|
| 4,429,985 | 2/1984 | Yokota | 399/165 |
| 4,561,757 | 12/1985 | Salomon et al. | 399/165 |
| 4,862,211 | 8/1989 | Kutami et al. | 399/165 |
| 5,070,365 | 12/1991 | Agarwal | 399/165 |
| 5,697,031 | 12/1997 | Kamiya et al. | 399/301 |

FOREIGN PATENT DOCUMENTS

| | | |
|---|---|---|
| 2-27383 | 1/1990 | Japan . |
| 4-257888 | 9/1992 | Japan . |
| 5-134556 | 5/1993 | Japan . |
| 6-35331 | 2/1994 | Japan . |
| 8-152812 | 6/1996 | Japan . |
| 9-16512 | 1/1997 | Japan . |
| 9-175686 | 7/1997 | Japan . |

*Primary Examiner*—William J. Royer
*Attorney, Agent, or Firm*—Finnegan, Henderson, Farabow, Garrett & Dunner, L.L.P.

[57] ABSTRACT

An improved image forming apparatus having an endless belt is provided. The apparatus uses an endless belt as a toner image carrier for holding a toner image thereon and transporting the toner image. In one embodiment, rib members are arranged on opposing ends of the endless belt to assist in inhibiting the endless belt from walking relative to a drive roll. A rib guide member is interposed between the rib member and the drive roll, and is rotatable independent of the drive roll. In another embodiment, the toner image is transferred from a photosensitive member to the endless transfer belt and then to a recording medium. Indicia is arranged on an outer perimeter surface of the endless transfer belt indicative of a position of the endless transfer belt, with a sensor used to detect the indicia.

9 Claims, 11 Drawing Sheets

| FACTOR | NUMBER OF SAMPLES 5 |
|---|---|
| ① REPETITION ACCURACY $\pm 3\sigma_{n-1}$ N=20 | 6.6～11.8 μm |
| ② POWER VOLTAGE VARIATION±0.03% | 0.6～1.0 μm/(0.03V) |
| ③ SENSING DISTANCE (BELT SURFACE VIBRATION) | 3.8～11.6 μm/(32 μm) |
| TOTAL ERROR $\sqrt{①^2+②^2+③^2}$ | 7.6～16.6 μm |

FIG.23
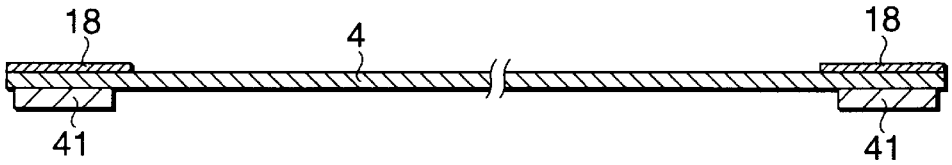
FIG.24
(JIS Z-0237)
| ITEM | UNIT | VALUE |
|---|---|---|
| TAPE THICKNESS | mm | 0.05 |
| TENSION STRENGTH | kgf/25mm | 9 |
| ELONGATION | % | 70 |
| ADHESIVE STRENGTH | gf/25mm | 1000 |
FIG.25
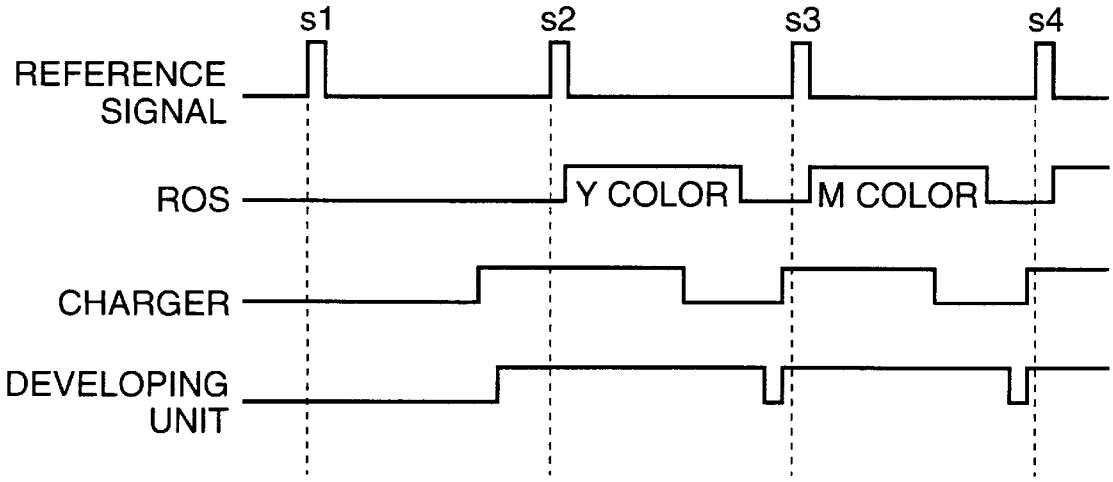

IMAGE FORMING APPARATUS HAVING AN ENDLESS BELT PROVIDED WITH RIBS AND INDICIA

BACKGROUND OF THE INVENTION

1. Field of the Invention

The present invention relates to an image forming apparatus, such as an electrophotographic copying machine or a laser printer, and more particularly to an image forming apparatus which forms an image by use of a belt-like image forming member, in particular a belt-like photosensitive member and a belt-like intermediate transfer member.

2. Description of the Related Art

An image forming apparatus, e.g., an electrophotography copying machine or a printer, forms an image in such a manner that a toner image is formed on an electrostatic latent image carrier, e.g., a photosensitive drum, and is transferred onto a recording medium, e.g., a sheet of paper. Two methods of transferring the toner image (not yet fixed) to a recording medium are known. A first method directly transfers the toner image onto the recording medium. A second method primarily transfers the toner image onto an intermediate transfer member formed of a film member taking the form of a drum or an endless belt, and secondarily transfers the toner image from the intermediate transfer member onto a recording medium.

FIG. 9 is a diagram showing a structure of a color printer as an example of the image forming apparatus using a belt-like intermediate transfer member. The surface of a latent image carrier (hereinafter referred to as a photosensitive drum) 1 is uniformly charged with predetermined charges by a charger 2, and is subjected to a write scan process by use of a laser beam L, so that an electrostatic latent image is formed in accordance with a first-color image signal by writing and scanning of a laser beam L. With rotation of the photosensitive drum 1 in the direction A, the latent image reaches a position facing a first-color developing device of a developing unit 3, and is developed into a toner image T by the first-color developing device. The photosensitive drum 1 is further rotated while carrying the toner image T.

An intermediate transfer belt 4 moves at a speed substantially equal to the peripheral speed of the photosensitive drum 1, in synchronism with the toner developing operation. In a primary transfer portion where a primary transfer roll 5 is disposed in contact with the intermediate transfer belt 4 in the vicinity of a position right under a contact position where the photosensitive drum 1 comes in contact with the intermediate transfer belt 4, the toner image T is transferred from the photosensitive drum 1 to the intermediate transfer belt 4 under a transfer electric field, which is applied to the primary transfer roll 5 and has an electric polarity opposite to that of the toner. Here, a primary transfer cycle is completed.

The toner image that has been primarily transferred onto the intermediate transfer belt 4 reaches a secondary transfer portion where a secondary transfer roll 6 is disposed, with circulating motion of the intermediate transfer belt 4. In the case of a full-color image forming apparatus, the process from the latent image forming operation to the primary transferring operation is repeated for a preset number of colors (generally, yellow (Y), magenta (M), cyan (C), and black (Bk)) to form toner images of multiple colors on the intermediate transfer belt 4 in a superposed fashion.

To form those color toner images, the developing unit 3 consists of a rotary machine which is formed with an yellow developing device 3-1, a magenta developing device 3-2, a cyan developing device 3-3, and a black developing device 3-4. The developing unit 3 thus constructed is capable of developing latent images that have been formed on the photosensitive drum 1, in a successive manner.

The first-color toner image carried on the photosensitive drum 1 is thus transferred onto the intermediate transfer belt 4 at the primary transfer portion; residual toner is removed from the photosensitive drum 1 by a cleaner 7; the drum surface is electrically neutralized by a charge remover (not shown); and then another latent image corresponding to the second color is formed on the drum surface. The second-color latent image, like the first-color latent image, is developed in a similar manner, so that the second toner image is formed superposed on the first color toner image that has been previously transferred on the intermediate transfer belt 4. Third- and fourth-color latent images are similarly developed on the second color toner image on the intermediate transfer belt 4. In this way, those color toner images are superposed to form a multi-color toner image, not yet fixed, on the intermediate transfer belt 4.

At the instant that the intermediate transfer belt 4 having the multi-color toner image primarily transferred thereon reaches a secondary transfer position, a recording medium, or a sheet of recording paper P, having been fed from the paper tray 8, reaches the secondary transfer position.

When the sheet of recording paper P is transported while being nipped between the secondary transfer roll 6 and the intermediate transfer belt 4, the toner image is secondarily transferred from the intermediate transfer belt 4 onto the sheet of paper P under a transfer electric field that is applied to the secondary transfer roll 6 and has a polarity opposite to the charging polarity of the toner image.

The sheet of paper P bearing the multi-color toner image transferred thereonto is transported to a fixing unit (fuser) 9 which in turn heats and presses the toner image against the sheet of paper P to fix the multi-color toner image on the sheet of paper P. Here, an image forming process is completed. A charge remover (not shown) is disposed downstream of the secondary transfer roll 6 to remove charge from the sheet of paper P having undergone a secondary image transfer process.

The secondary transfer roll 6 is provided in a state that it may be brought into contact with and detached from the intermediate transfer belt 4 in the directions of arrows C. The roll 6 comes into contact with the intermediate transfer belt 4 when the sheet of paper P reaches the secondary transfer position, and is detached from the intermediate transfer belt 4 when the sheet of paper leaves there. The secondary transfer roll 6 returns to a stand-by position upon the end of the secondary transfer. A cleaner 10 disposed facing the intermediate transfer belt 4 is also brought into contact with the intermediate transfer belt 4 to clean the toner residual on (not transferred to) the belt 4, and detached therefrom after its removal.

Thus, in the color image forming apparatus using the intermediate transfer belt, the composite toner image (formed by superposing toner images) that has been already transferred onto the intermediate transfer belt in a superposing fashion is transferred onto the recording medium. Therefore, the apparatus is superior to the image forming apparatus of the type in which color toner images are successively and directly transferred onto the recording medium in that the composite image suffers from less misregistration and less deformation.

The intermediate transfer belt 4 is stretched by a drive roll 11, an idle roll 12, a secondary-transfer backup roll 13, and a tension roll 14, and driven by the drive roll 11 to move in the direction of arrow B. Widthwise-motion suppressing means including a rib and a rib guide is provided in association with the intermediate transfer belt 4. The suppressing means is for suppressing motions of the drive roll 11 and the like in the axial direction of the rolls.

The surface of the drive roll 11 is coated with high friction material so as to prevent slippage of the intermediate transfer belt 4 when the cleaner 10 and the secondary transfer roll 6 are loaded on the surface of the transfer belt 4.

Various proposals have been made to suppress a variation of a circulating velocity of the intermediate transfer belt 4, to render those rolls, e.g., the drive roll 11, immovable in their axial directions, to prevent the ends of the intermediate transfer belt 4 from being broken, and for other purposes.

Japanese Patent Unexamined Publication No. Hei. 2-27383 discloses a technique in which a rib is provided at one end (out of an image forming area) of the intermediate transfer belt, and grooves are provided in the rolls, while corresponding in position to the rib, and the coefficient of friction of the rib is different from that of the intermediate transfer belt. Japanese Patent Unexamined Publication No. Hei. 4-257888 discloses another technique in which ribs are formed at both ends of the belt put on the drive roll and the follower roll, and grooves are formed at both ends of the drive roll and the follower roll, while corresponding in position to the ribs.

Japanese Patent Unexamined Publication No. Hei. 5-134556 discloses a transfer belt with a tape (as a reinforcing member) stuck onto the end thereof. In this transfer belt, the outside diameter of the roll is reduced at its location corresponding to the reinforcing tape in order to prevent the transfer belt from rising at the contact portion of the roll and the tape and to prevent the boundary between the transfer belt and therein forcing member from being cracked.

Japanese Patent Unexamined Publication Nos. Hei. 9-175686 and Hei. 9-16512 disclose a technique in which the intermediate transfer belt is fastened to the rib by stitching, thereby preventing the intermediate transfer belt from slipping off the rib.

Japanese Patent Unexamined Publication No. Hei. 6-35331 discloses a technique for preventing the intermediate transfer belt from slipping on the drive roll. In this technique, irregularities of 20 to 100 $\mu$m high are formed on the surface of the drive roll. Japanese Patent Unexamined Publication No. Hei. 8-152812 discloses a technique in which the inner surface of the intermediate transfer belt and/or the surface of the drive roll is coated with adhesive or high friction resin.

In the image forming apparatus which is provided with the intermediate transfer belt and the drive roll for driving it, and the combination of the rib and the rib guide for preventing the zig-zag motions of the belt and roll in their axial directions, the intermediate transfer belt is a semiconductive film, 50 to 100 $\mu$m thick, consisting of a resin base made of polycarbonate or polyimide and resistance adjusting material. The surface of the drive roll is generally processed for high friction for preventing a slippage of the roll and the belt.

For the high friction process, the surface of the aluminum roll is coated with high friction resin, e.g., urethane rubber, so as to maintain a satisfactory coefficient of friction of the drive roll to the intermediate transfer belt for a long time. When the drive roll and the belt are new, the friction coefficient of the surface of the drive roll is too high. The result is that the belt repeats a stick slip in the axial direction to possibly squeak.

During the circulation of the intermediate transfer belt stretched out on a plural number of rolls, the belt takes a motion in its axial direction (the motion is called a walk). The walk is controlled to be within a predetermined amount of walk by the combination of the rib and the rib guide. When a state that the walk takes place and the rib and the rib guide mutually push continues for a long time, the end of the intermediate transfer belt will be broken in particular when the mechanical strength of the belt end is insufficient. In this state, the apparatus cannot continue its image forming operation.

Such a strong force as to break the intermediate transfer belt is caused by degradation of the flatness of the belt system, which is due to poor levelness of the apparatus body, twists caused by the stacking of component parts on the front and rear side plates of the apparatus body and assembling errors, circumferential length difference between both sides of the ends of the belt in the axial direction, and the like. There is a possibility that the intermediate transfer belt as the image carrier in the image forming apparatus can be broken to the intermediate transfer belt.

A mechanism to break the intermediate transfer belt will be described. The combination of a new drive roll and a new intermediate transfer belt has a high coefficient of friction, and hence a high gripping force is also created. Therefore, when the rolls supporting the intermediate transfer belt lose their alignment (parallelism of the axes of the rolls), the belt is liable to walk even if the misalignment is slight. In this case, the moving belt shifts sideways for a short time or after it has traveled several tens of cycles, and the rib abuts against the rib guide by a strong gripping force.

At a position where the belt is put on the drive roll and at a position where the belt leaves the drive roll, the following forces act on the side face of the rib. FIG. 10 is a cross sectional view showing the intermediate transfer belt 4 put on the drive roll 11, and FIG. 11 is a cross sectional view showing a contact state of the drive roll 11 with the intermediate transfer belt 4. In those figures, to prevent the walk of the intermediate transfer belt 4, ribs 41 are provided on both sides of the back surface of the intermediate transfer belt 4 in a state that it is in contact with the side faces of the drive roll 11.

When the intermediate transfer belt 4 walks and comes in contact with the side face of the drive roll 11, a force F1 acts on the side face of the rib 41 in a region R1 in which the intermediate transfer belt 4 begins to contact with the drive roll 11. The force F1 acts so as to cause the intermediate transfer belt 4 to rise and run onto the drive roll 11. In a region R2 where the lifted intermediate transfer belt 4 leaves the drive roll 11, the lift of the intermediate transfer belt 4 disappears.

FIG. 12 is a cross sectional view showing the intermediate transfer belt 4 when it is lifted. The intermediate transfer belt 4 is lifted by the force F1, while at the same time a strong pushing force acts on the side face of the rib 41, whereby a rise portion RU is formed. This rise portion RU disappears in the region R2. In the vicinity of the drive roll 11, the side ends of the intermediate transfer belt 4 are repetitively deformed alternately in one direction and the other direction that is opposite to the former: the side ends of the belt are repetitively subjected to an alternate process of the concentration and release of stress.

The force to press the rib 41 against the side face of the drive roll 11 increases as the gripping force is larger and the degree of misalignment is greater. In this state, the intermediate transfer belt 4 is liable to rise. When the rib 41 is forcibly pressed against the side face of the drive roll 11, the alternate concentration and release of stress is repeated and further the belt drive force is transmitted from the roll side face through the rib to the belt. The drive force to drive the belt is somewhat different from the drive force applied to the belt from the drive roll surface. The drive force difference produces a strain in the belt. The strain leads to accumulation of stress and generation of a squeaking sound by rubbing of the intermediate transfer belt 4 with the drive roll 11.

The concentration and release of stress are alternately repeated in the rise portion RU and the strain of the belt end is accumulated. When the operation of the image forming apparatus continues in this state, a fatigue is accumulated in the rise portion RU to give rise to a crack CR. The local crack CR grows into a breakage of the whole intermediate transfer belt 4 (FIG. 13). Further, there is a danger that a notch N of the end of the intermediate transfer belt 4 easily grows into the breakage of the whole intermediate transfer belt 4 (FIG. 14).

To prevent the walk of the intermediate transfer belt, it is, as a matter of course, necessary to secure accurate working of component parts and assembling of them. To this end, it is required that the rolls supporting the intermediate transfer belt are exactly aligned to one another and the intermediate transfer belt is accurately worked to have little difference of its circumferential length between the sides of the belt.

The approach of improving the mechanical precision of the intermediate transfer belt and its related rolls brings about the complexity of the steps of working, assembling and adjusting. In this respect, the approach is not suitable for the mass production of the image forming apparatuses. Even if the problems in the manufacturing stage are solved, the following problem is still present; when the image forming apparatus is installed on a place of poor levelness, it is impossible to secure the required accuracy of the alignment among the rolls that support the intermediate transfer belt.

To prevent the walk problem, it is necessary to strictly manage the precision of the component parts and assembling of them as described above. Further, some measure for improvement must be taken for other factors that may cause the walk producing the strong pushing force, e.g., the gripping force.

Incidentally, the image forming apparatus in which the intermediate transfer belt is controlled in its position by bringing the rib into contact with the ends of the rolls supporting the transfer belt, is disclosed in Japanese Patent Unexamined Publication No. Hei. 5-134556, already referred to. In the apparatus, a tape as the reinforcing member is applied to the end of the transfer belt for the purpose of preventing the belt end to be pressed against the roll ends from being deformed.

The above image forming apparatus composes the toner images of different colors on the intermediate transfer belt. Therefore, it is essential to accurately register those color toner images or to prevent a misregistration of those color toner images (referred to frequently as a color misregistration). To this end, it is necessary to accurately detect the reference position on the intermediate transfer belt and to control the operations of the related portions in the image forming apparatus in accordance with the detecting signal indicative of the reference position. To detect the reference position, the conventional technique detects a paint or a tape on the intermediate transfer belt, reads a mark (e.g., a through-hole) on the belt by use of a reflection type sensor, or reads a rotation position on the drive roll for the belt by use of an encoder.

In the reference-position detecting method using the mark of the through-hole, stress concentrates at the through-hole, possibly cracking the intermediate transfer belt. In the detecting method of reading the rotation position of the drive roll, an error that arises from slippage between the belt and the drive roll is liable to occur. The detecting method using the paint or tape is free from such problems.

However, the method using the paint or tape has the following problem. To reduce the misregistration of the color toner images, it is necessary to detect the mark of the paint or tape considerably accurately. For example, to reduce the color misregistration to 125 $\mu$m, the mark detection error should be within 15 $\mu$m.

To satisfy such a strict requirement, it is necessary to eliminate various factors causing detection errors, such as the traveling speed of the intermediate transfer belt, the bending and vibration of the intermediate transfer belt during its traveling, and the mounting position of the reflection type sensor.

SUMMARY OF THE INVENTION

The present invention has been made in view of the above circumstances and an object of the present invention is to provide an image forming apparatus which is free from such a problem that the forces produced when an endless belt as an image carrier walks and a rib comes in contact with rolls, deform and break the endless belt.

In order to achieve the above object, according to a first aspect of the invention, there is provided an image forming apparatus comprising: an endless belt as a toner image carrier for holding a toner image thereon and transporting the same; belt supporting means including a plural number of rolls, including a drive roll, for supporting the endless belt; rib members provided on and along both side ends of an inner surface of the endless belt; and rib guide members, provided at least at both ends of the drive roll of the belt supporting means, for guiding the rib members, wherein the rib guide members are rotatable independently of the drive roll.

Further, another object of the present invention is to provide an image forming belt apparatus which secures an accurate detection of a reference position on an endless belt to reproduce a satisfactory multi-color image which is free from the color misregistration.

In order to achieve the above object, according to a second aspect of the invention, there is provided an image forming belt apparatus comprising: an endless belt; a plural number of rolls, including at least a drive roll, for supporting the endless belt; rib members provided on and along both side ends of an inner surface of the endless belt, the rib members being brought into contact with end faces of the rolls to limit a widthwise motion of the endless belt; a mark formed on one side end of an outer peripheral surface of the endless belt; sensor means for optically sensing the mark to output a signal indicative of a reference position on the endless belt; and belt biasing means for biasing the endless belt toward a mark-formed side in an axial direction of the rolls.

Further, according to a third aspect of the invention, there is provided an image forming belt apparatus comprising: an endless belt; a plural number of rolls, including at least a drive roll, for supporting the endless belt; rib members provided on and along both side ends of an inner surface of the endless belt, the rib members being brought into contact with end faces of the rolls to limit a widthwise motion of the endless belt; a mark formed on one side end of an outer peripheral surface of the endless belt; and sensor means for optically sensing the mark to output a signal indicative of a reference position on the endless belt, wherein a circumferential length of the endless belt is varied in a widthwise direction of the endless belt to bias the endless belt toward a mark-formed side in an axial direction of the rolls.

Furthermore, according to a fourth aspect of the invention, there is provided an image forming apparatus in which a toner image is primarily transferred from a photosensitive member onto an intermediate transfer belt and the toner image primarily transferred is secondarily transferred onto a recording medium, the image forming apparatus comprising: belt supporting means, -including a plural number of rolls including at least a drive roll, for supporting and moving the intermediate transfer belt; a mark indicative of a reference position on the intermediate transfer belt, provided on an outer peripheral surface of the intermediate transfer belt; detecting means for optically detecting the mark, the detecting means being disposed in a slack portion of the intermediate transfer belt while facing one side end of the outer peripheral surface of the intermediate transfer belt; and primary transfer means disposed in a taut portion of the intermediate transfer belt.

BRIEF DESCRIPTION OF THE DRAWINGS

FIG. 23 is a cross sectional view showing the intermediate transfer belt in a sixth embodiment of the present invention;

FIG. 24 is a table showing the characteristics of a reflection tape; and

FIG. 25 is a timing chart showing an operation for image formation.

DETAILED DESCRIPTION OF THE PREFERRED EMBODIMENTS

Figure 9:
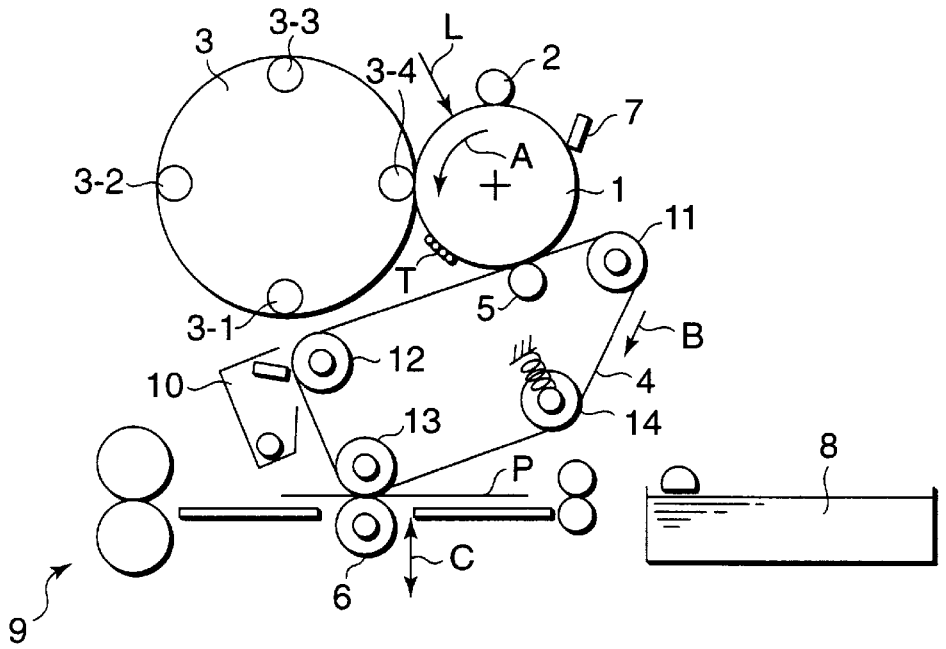
FIG. 9 is a diagram schematically showing a structure of a color printer which is an example of the image forming apparatus using the intermediate transfer belt.
Figure 10:
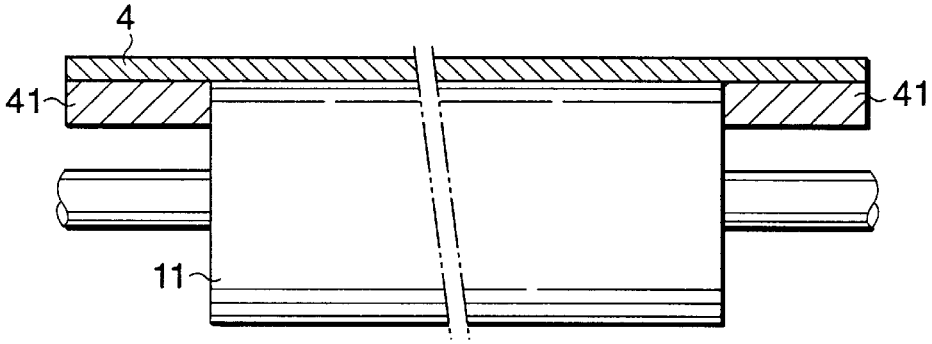
FIG. 10 is a cross sectional view showing an intermediate transfer belt put on the drive roll.

The preferred embodiments of the image forming apparatus according to the present invention will be described with reference to the accompanying drawings. In the embodiment descriptions to be given hereunder, FIG. 9 will be referred to frequently for the descriptions of the construction and operations of the image forming apparatus.

Figure 4:
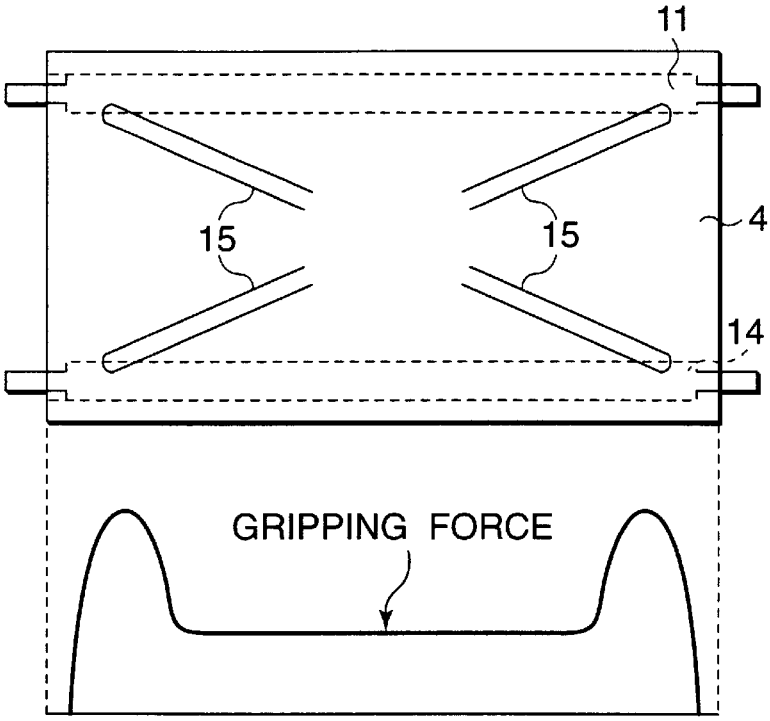
FIG. 4 is a diagram showing tension lines appearing on an intermediate transfer belt and a graphical representation of a distribution of gripping force across the intermediate transfer belt.

FIG. 4 shows a diagram useful in explaining a tension developed in the intermediate transfer belt (endless belt) 4 stretched out on the rolls. When the intermediate transfer belt 4 is stretched out on the drive roll 11, the idle roll 12, the tension roll 14, and the secondary-transfer backup roll 13 and a tension is applied to the roll 14, then tension lines 15 appear on the intermediate transfer belt 4 as shown in FIG. 4. The tension lines 15 are "creases" of the intermediate transfer belt 4, which are caused by a non-uniform distribution of tension in and over the intermediate transfer belt 4. The "creases" teach that a tension distributed in each side end of the intermediate transfer belt 4 is larger than that in the central porion thereof. With the tension difference, a gripping force Gr is distributed over the drive roll 11 in its axial direction as shown. As seen, the gripping force Gr is considerably large at both ends of the drive roll 11.

Figure 5:
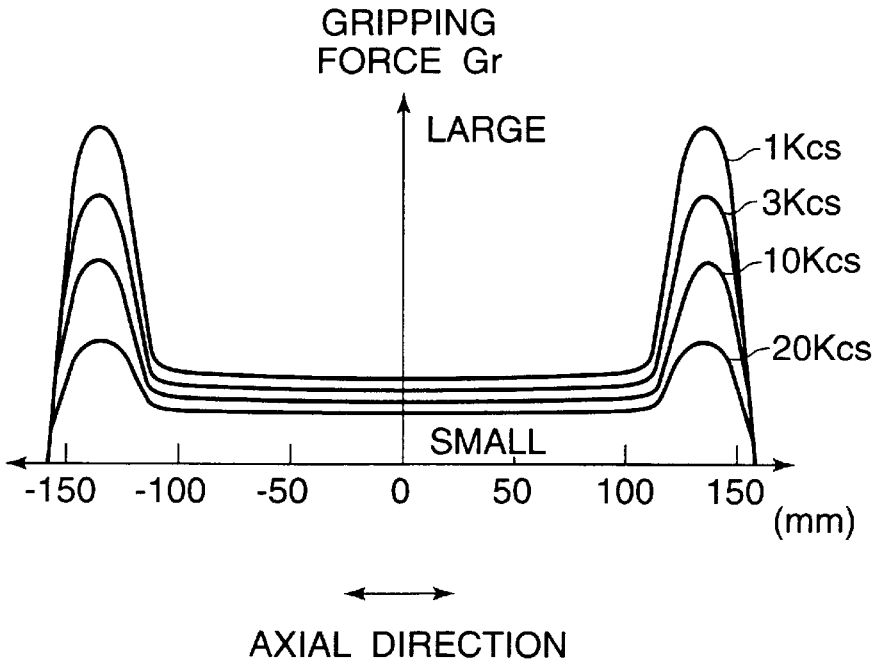
FIG. 5 is a graphical representation of distributions of gripping force over drive rolls different in their use time.

FIG. 5 shows variations of the gripping force Gr over the drive roll 11 in its axial direction. As shown, distributions of the gripping force Gr of four kinds of drive rolls 11 were measured in a state that those drive rolls are applied to the intermediate transfer belts 4 which are different in their use periods of time or the number of belt cycles (expressed in the unit of kilo cycles (kcs)). The graph shows that the nonuniformity of the distribution of the gripping force Gr is greater, the newer the drive roll 11 is, and that where the use period of the transfer belt is long, the variation of the gripping force Gr over the length of the drive roll is small.

Figure 6:
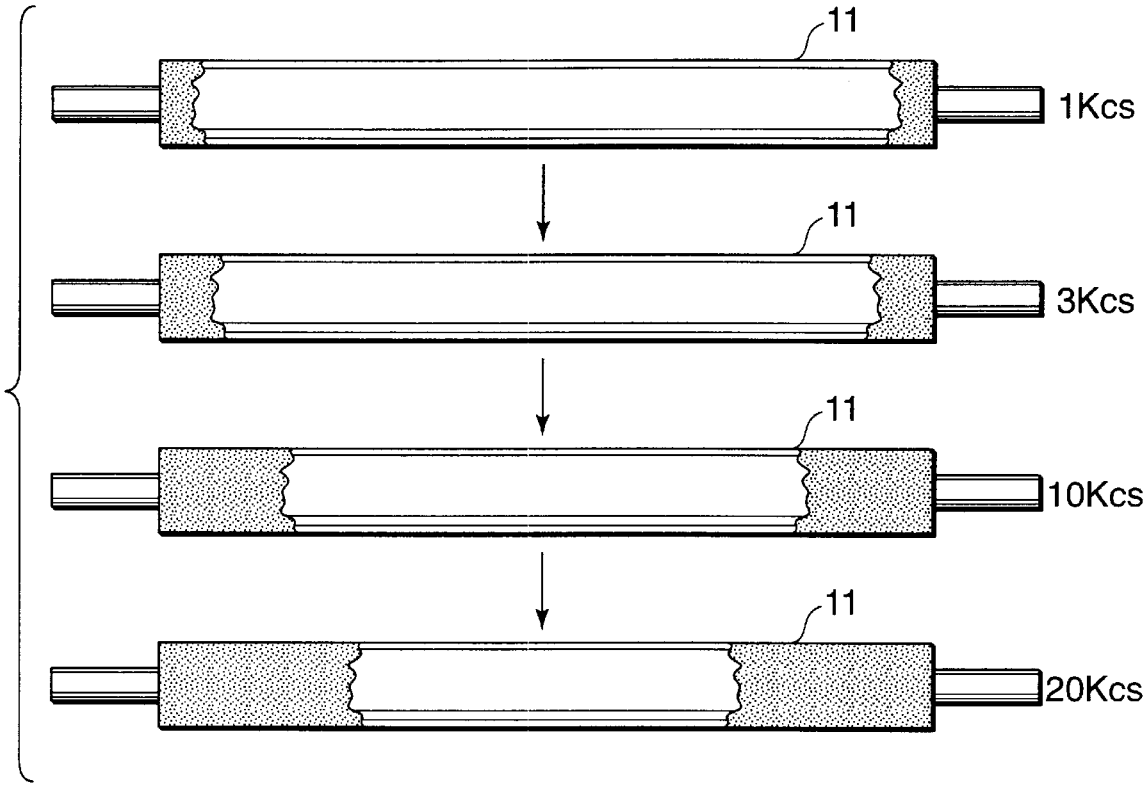
FIG. 6 is a diagram showing how the dirt and grime on the drive roll increasingly expands with its use time.

As seen, the gripping force decreases at both ends of the drive roll. The reason for this is that the grime grows on the roll surface. FIG. 6 shows how the grime or dirt on the surface of the drive roll 11 increasingly expands with its use time. As seen, the grime grows and expands from the roll ends to the roll center. The scraping of the back surface of the intermediate transfer belt 4 mainly contributes to formation of the grime. Toner particles floating within the apparatus also contributes to the formation of the other dirt. At about 10 kcs, the dirt extends over the full axial length of the drive roll 11 and is saturated.

Figure 13:
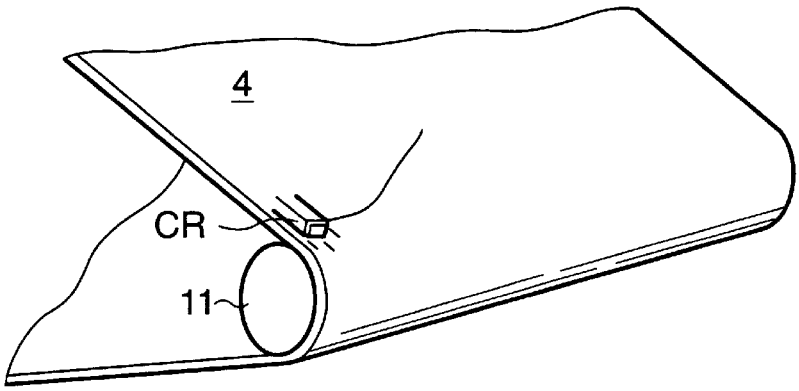
FIG. 13 is a perspective view showing an example of crack formed at the side end of the intermediate transfer belt.
Figure 14:
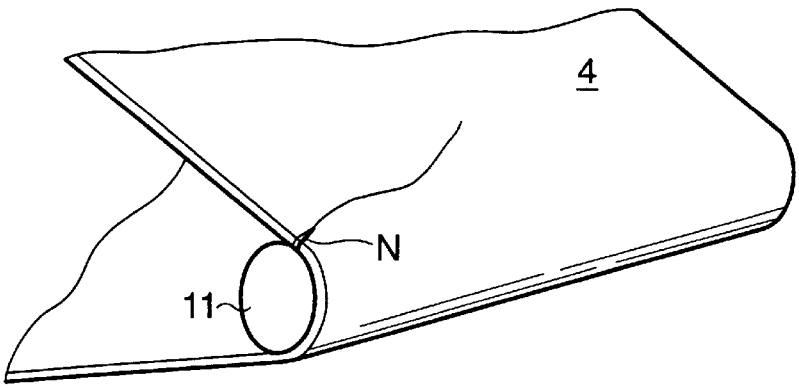
FIG. 14 is a perspective view showing an example of a crack developed from a notch present at the side end of the intermediate transfer belt.

Thus, when the drive roll 11 is new, its gripping force is large. Therefore, the side ends of the intermediate transfer belt 4 are repeatedly deformed by its walk, and are liable to be damaged (FIGS. 13 and 14). If the tension roll 14 is loosened, the belt tension decreases in magnitude and then the gripping force Gr decreases. Therefore, the damage of the intermediate transfer belt 4 maybe avoided by loosening of the tension roll 14. However, if the gripping force Gr is excessively reduced, another problem arises: For example, misregistration is produced among the color toner images to be superposed on the intermediate transfer belt 4.

Figure 7:
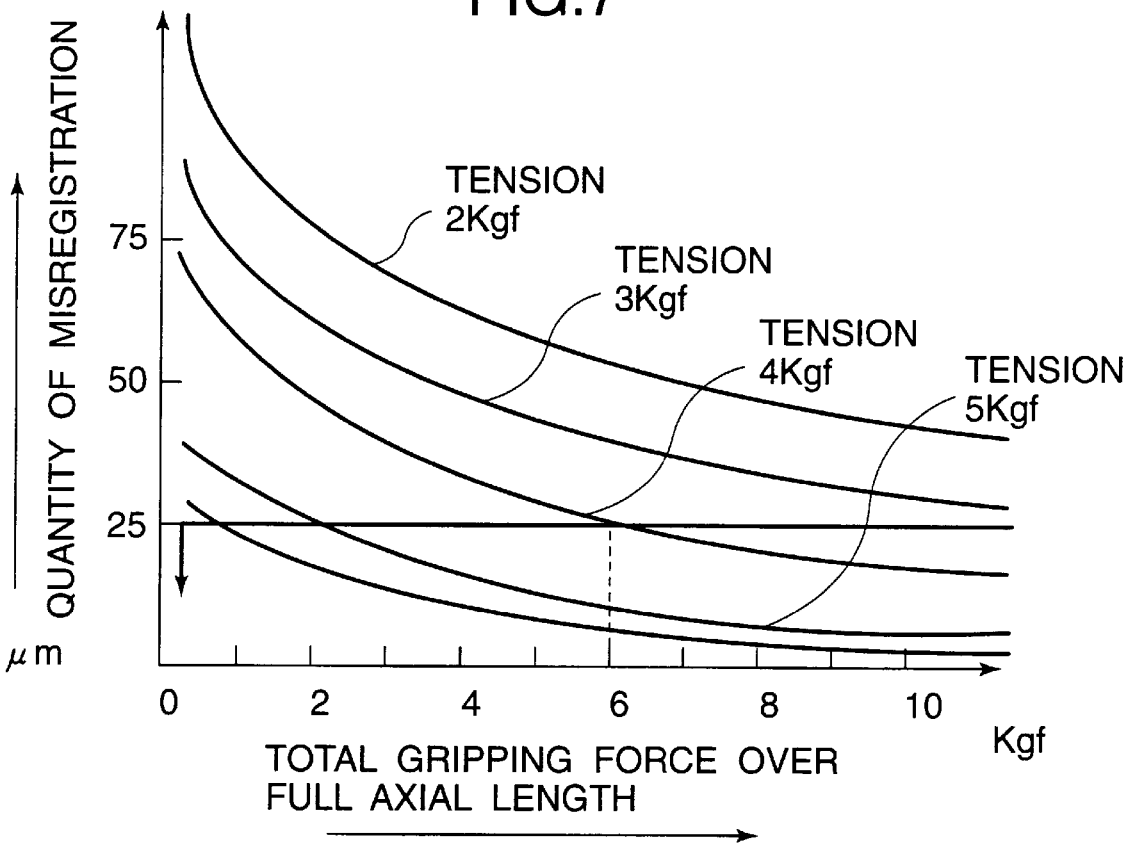
FIG. 7 is a graph showing variations of quantities of the color misregistration with respect to a total gripping force over the full axial length of the drive roll, with a belt tension as a parameter.

FIG. 7 shows variations of quantities of color misregistration with respect to a total gripping force over the full axial length of the drive roll 11. In the graph, a belt tension is used as a parameter. Here, the "total gripping force" means a static starting torque measured by a torque meter which is attached to the shaft of the drive roll 11 in a state that the idle roll 12 and the intermediate transfer belt 4 are fixed. From the graph, it is seen that when the belt tension is 4 kgf, and for example, 25 $\mu$m of the tolerance of the color image misregistration of the whole image forming apparatus is assigned to the intermediate transfer belt 4, the total gripping force must be at least 6 kgf.

As described above, the surface dirt of the drive roll 11 is saturated at about 10 kcs. Therefore, the total gripping force must be set at least 6 kgf for the use time of 10 kcs or larger. In design to secure a large gripping force at 10 kcs or larger, the total gripping force is considerably large in an early stage where the roll surface grime is not large. In this state, the deformation of the intermediate transfer belt 4 caused by the walk is unavoidable. Most of the damages of the intermediate transfer belt 4 occur in the early stage of large gripping force.

To reduce the color misregistration and to prevent the damage of the intermediate transfer belt 4, the present embodiment takes the following measure. As described above, the gripping force Gr is large at both ends of the drive roll 11, and this phenomenon is distinguished in particular in the early stage of using the drive roll. For this reason, the ends of the drive roll are processed to be low in friction in the embodiment.

Figure 8:
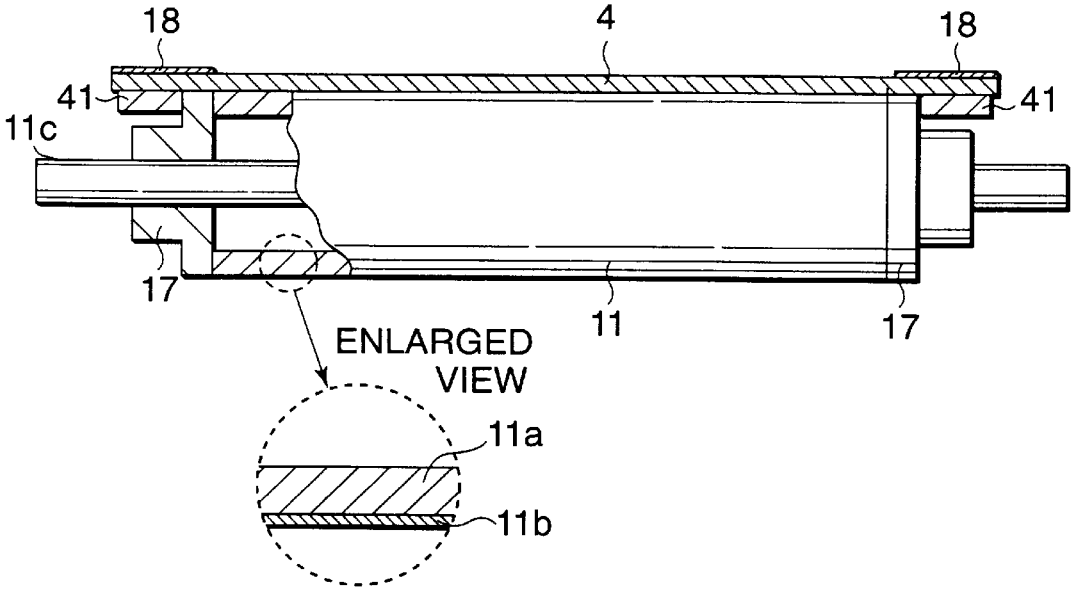
FIG. 8 is a cross sectional view showing a structure including the drive roll and the intermediate transfer belt.

FIG. 8 schematically shows a structure including the drive roll 11 and the intermediate transfer belt 4. As shown, the drive roll 11 includes a roll body 11*a* and a high friction layer 11*b* applied to the surface of the roll body 11*a*. The high friction layer 11*b* is provided for preventing the intermediate transfer belt 4 from slipping on the drive roll 11 also when the cleaner 10 or the secondary transfer roll 6 is loaded on the belt 4. The roll body 11*a* may be a tube made of aluminum. The high friction layer 11*b* may be a layer, 5 to 50 $\mu$m thick, preferably 25 $\mu$m thick, made of polyurethane rubber.

A rib guide 17 is provided at each end of the drive roll 11. The rib guide 17 is made preferably of a resin material, e.g., polyacetal, which provides a smooth surface and a good sliding performance. It is preferable that the rib guide 17 is separated from the side face of the roll body 11*a*. The same type of rib guide is provided on the idle roll 12 and the tension roll 14 in a similar fashion.

The intermediate transfer belt 4 is a semiconductive film made of polyimide resin which is 50 to 100 $\mu$m in thickness and $10^9$ to $10^{12}\Omega\cdot$cm in volume resistivity, and $10^{11}$ to $10^{13}\Omega/\square$ in surface resistivity. The intermediate transfer belt 4 may be made of acrylic resin, vinyl chloride resin or polycarbonate resin containing electric resistance stabilizing agent if it belongs to semiconductive resin material of which the values of the thickness, volume resistivity, and surface resistivity are within the above mentioned ones.

Ribs 41 are provided on both side ends of the inner surface of the intermediate transfer belt 4, i.e., the surface opposite to the image carrying surface of the belt 4. The inner sides of the ribs 41, i.e., the faces of these ribs located closer to the center of the drive roll 11 when viewed in the axial direction thereof, abut on the ends of the rib guides 17 provided at both ends of the drive roll 11 to limit motions of the intermediate transfer belt 4 on the drive roll 11 in the axial directions of the drive roll 11. Tapes 18 as reinforcing members for reinforcing the side ends of the intermediate transfer belt 4 are bonded onto both side ends of the outer surface, i.e., the image carrying surface, of the intermediate transfer belt 4. Each tape may be a polyethylene terephthalate (PET) film of 50 to 100 $\mu$m thick.

<First Embodiment>

Figure 1:
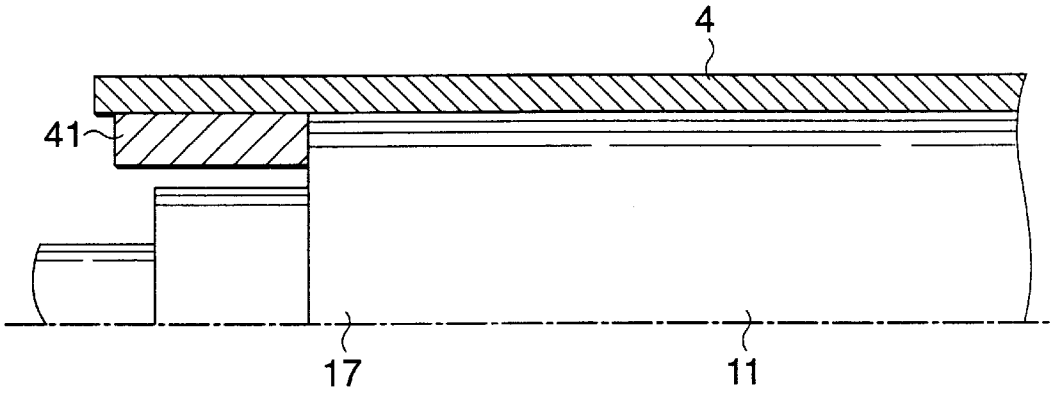
FIG. 1 is a cross sectional view showing a friction reduction structure of a drive roll incorporated into an image forming apparatus which forms a first embodiment of the present invention.

An image forming apparatus which forms a first embodiment of the present invention will be described with reference to FIG. 1. FIG. 1 shows a friction reduction structure of a drive roll incorporated into the image forming apparatus. In the first embodiment, to reduce friction at both ends of the drive roll 11, rib guides 17 are rotatable independently of the drive roll 11.

Here, it is assumed that the rib guide 17 is designed to turn together with the drive roll 11. In this case, the rib 41 of the intermediate transfer belt is in contact with the side face of the rib guide 17. Therefore, rib 41 receives a drive force from the side face of the rib guide 17. A rotational speed of the side face of the rib guide 17 at a portion where it contacts with the rib 41 is smaller than a rotational speed of the outer peripheral surface of the drive roll 11. The result is that a belt speed at the central part of the intermediate transfer belt 4 is different from that at both side ends of the belt. The belt speed difference produces strain in the belt 4.

However, in this embodiment, the rib guides 17 are rotatable independently of the drive roll 11 as mentioned above. This friction reduction structure disconnects the drive force transmission path ranging from the roll side surface to the intermediate transfer belt 4 via the rib 41. As a result, the intermediate transfer belt 4 receives a drive force from only the outer peripheral surface of the drive roll 11. No strain is generated in the belt 4 and hence no stress is caused in the belt. No squeaking sound is generated from the belt. No or less damage of the side ends of the belt 4 is achieved.

It is readily seen that the FIG. 1 friction reduction structure to reduce the friction at both ends of the drive roll 11 is applicable to the tension roll 14. In this case, rib guides 17 are provided at both ends of the tension roll 14 in a state that the rib guides are rotatable independently of the tension roll. The same friction reduction structure may be applied to the idle roll 12 and the secondary-transfer backup roll 13, as a matter of course.

In case where the friction reduction structure (including the independently rotatable rib guides) is used for the drive roll 11 and at least one of the tension roll 14 and the idle roll 12, it is preferable that the rib guide is positioned within a range from 0 to 0.5 mm for each width of 350 mm in the axial direction at each same side ends of those rolls 11 and 14 and/or 12, in a belt unit in which the intermediate transfer belt 4 is stretched out on the rollers and turned.

<Second Embodiment>

Figure 2:
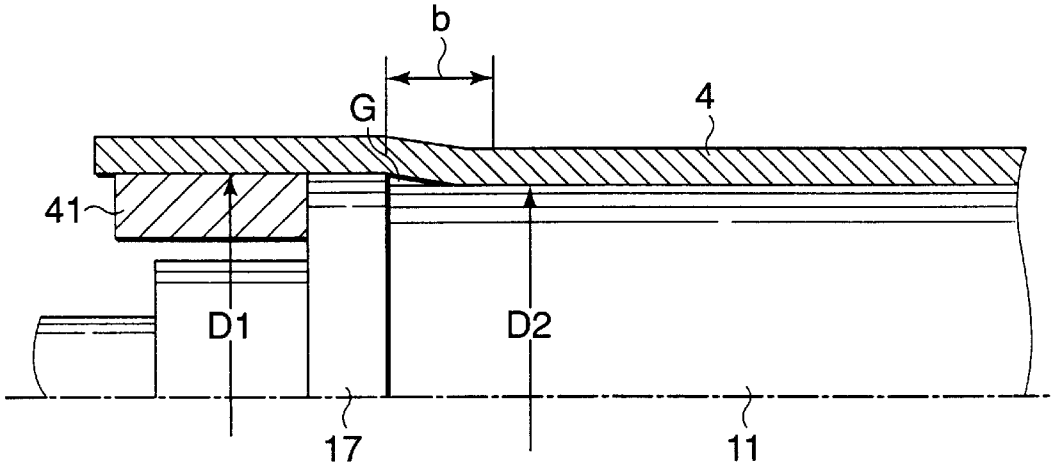
FIG. 2 is a cross sectional view showing another friction reduction structure of a drive roll incorporated in an image forming apparatus which forms a second embodiment of the present invention.

An image forming apparatus which forms a second embodiment of the present invention will be described with reference to FIG. 2. FIG. 2 shows another friction reduction structure of a drive roll incorporated into the image forming apparatus. In the second embodiment, to reduce friction at both ends of the drive roll 11, the diameter of each rib guide 17 is larger than the outside diameter of the drive roll 11, and the rib guides 17 are rotatable independently of the drive roll 11. As shown, the diameter D1 of the rib guide 17 is slightly larger than the outside diameter D2 of the drive roll 11, and the rib guides 17 are rotatable independently of the drive roll 11.

Because of the presence of the diameter difference, a gap G is created between the end of the drive roll 11 and the back side or surface of the intermediate transfer belt 4 in a region b near the end of the drive roll 11. In the vicinity of the region b including the gap G, a friction created between the drive roll 11 and the intermediate transfer belt 4 is zero or considerably low. As a result, the gripping force of the drive roll 11 is reduced at both ends of the drive roll 11. Further, the rib guides 17 are rotatable independently of the drive roll 11. Because of this structure, when the belt 4 is driven to turn by the drive roll 11, no or little force is transmitted from the side face of the roll through the rib 41 to the intermediate transfer belt 4. As a result, the intermediate transfer belt 4 receives a drive force from only the outer peripheral surface of the drive roll 11. No strain is generated in the belt 4, and hence no or less damage of the side ends of the belt 4 is achieved.

It is readily seen that the FIG. 2 friction reduction structure to reduce the friction at both ends of the drive roll 11 is applicable to the tension roll 14. In this case, rib guides 17 are provided at both ends of the tension roll 14 in a state that the diameter of each rib guide is slightly larger than the outside diameter of the tension roll 14, and the rib guides are rotatable independently of the tension roll. The same friction reduction structure may also be applied to the idle roll 12 and the secondary-transfer backup roll 13, as a matter of course.

In case where the friction reduction structure (including the independently rotatable rib guides) is used for the drive roll 11 and at least one of the tension roll 14 and the idle roll 12 as in the first embodiment, it is preferable that the rib guide is positioned within a range from 0 to 0.5 mm for each width of 350 mm in the axial direction at each same side ends of those rolls 11 and 14 and/or 12, in a belt unit in which the intermediate transfer belt 4 is stretched out on the rollers and turned. The tests, conducted by us, show that the diameter D1 of the rib guide 17 is preferably 0.3 mm to 0.6 mm larger than the diameter D2 of the roll 11, 14 or 12.

<Third Embodiment>

Figure 3:
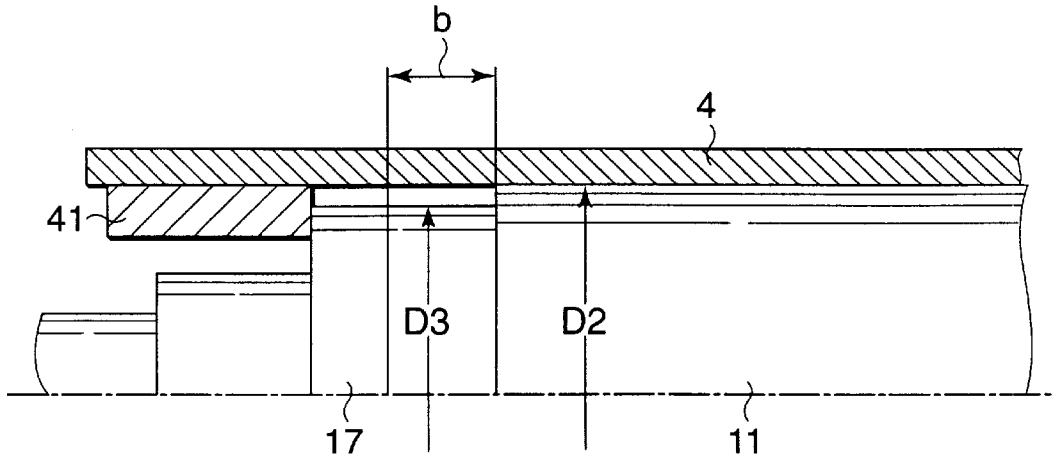
FIG. 3 is a cross sectional view showing still another friction reduction structure of a drive roll incorporated into an image forming apparatus which forms a third embodiment of the present invention.

An image forming apparatus which forms a third embodiment of the present invention will be described with reference to FIG. 3. FIG. 3 shows still another friction reduction structure of a drive roll incorporated into the image forming apparatus. In the third embodiment, the ends of the drive roll 11 may be reduced in diameter, while the rib guides 17 are increased in diameter in the above-mentioned embodiments, and further the rib guides 17 are rotatable independently of the drive roll 11. The diameter D3 of a region or portion b of each end of the drive roll 11, which faces the back side of the intermediate transfer belt 4 and adjoins to the inner side of the corresponding rib 41, is slightly smaller than the diameter D2 of the remaining portion of the drive roll 11, whereby in this portion b, a gap is formed between the back side of the intermediate transfer belt 4 and the outer periphery surface of the drive roll 11.

<Fourth Embodiment>

Figure 11:
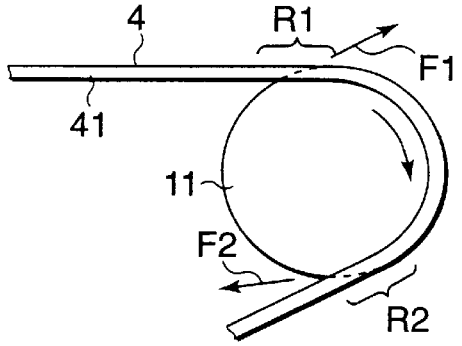
FIG. 11 is a cross sectional view showing a contact state of the drive roll with the intermediate transfer belt.
Figure 12:
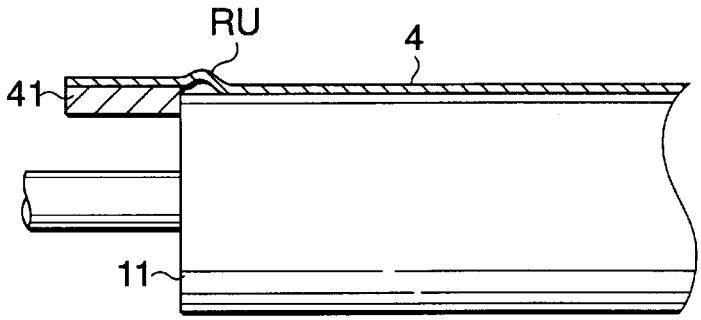
FIG. 12 is a cross sectional view showing a rise formed at the side end of the intermediate transfer belt.

An image forming apparatus which forms a fourth embodiment of the present invention will be described with reference to FIGS. 1–4. In the fourth embodiment, to reduce friction at both ends of the drive roll 11, a sliding resistance of the rib guide 17 to the rib 41 is reduced by properly selecting a material of the rib guide 17 and properly finishing the surface of the rib guide 17. In other words, the coefficient of friction of the sliding surface of the rib guide 17 to the rib 41 is selected to be smaller than that of the rib 41, whereby the force F1 acting so as to cause the intermediate transfer belt 4 to rise and run onto the drive roll 11 (FIG. 11) is reduced and hence the height of the rise portion RU is reduced. The rib guide 17 is made preferably of a resin material, e.g., polyacetal, which provides a smooth surface and a good sliding performance. A combination of the fourth embodiment with the first or second embodiment will produce more favorable effects.

As described above, in the first to fourth embodiments, the gripping force, which tends to increase at both side ends of the intermediate transfer belt (endless belt), can be uniformized over the entire axial length of the drive roll. Therefore, the embodiments of the invention are free from such an unwanted phenomenon essential to the conventional image forming apparatus; the intermediate transfer belt walks and rises on the drive roll. It rarely happens that the repetitive deformation of the intermediate transfer belt, caused by the rise of the belt, fatigues the belt, possibly damaging (e.g., cracking) the belt.

<Fifth Embodiment>

An image forming apparatus which forms a fifth embodiment of the present invention will be described with reference to FIG. 15. The fifth embodiment is designed so as to accurately detect a reference position on an intermediate transfer belt and to reproduce a satisfactory multi-color image free from the color misregistration.

Figure 15:
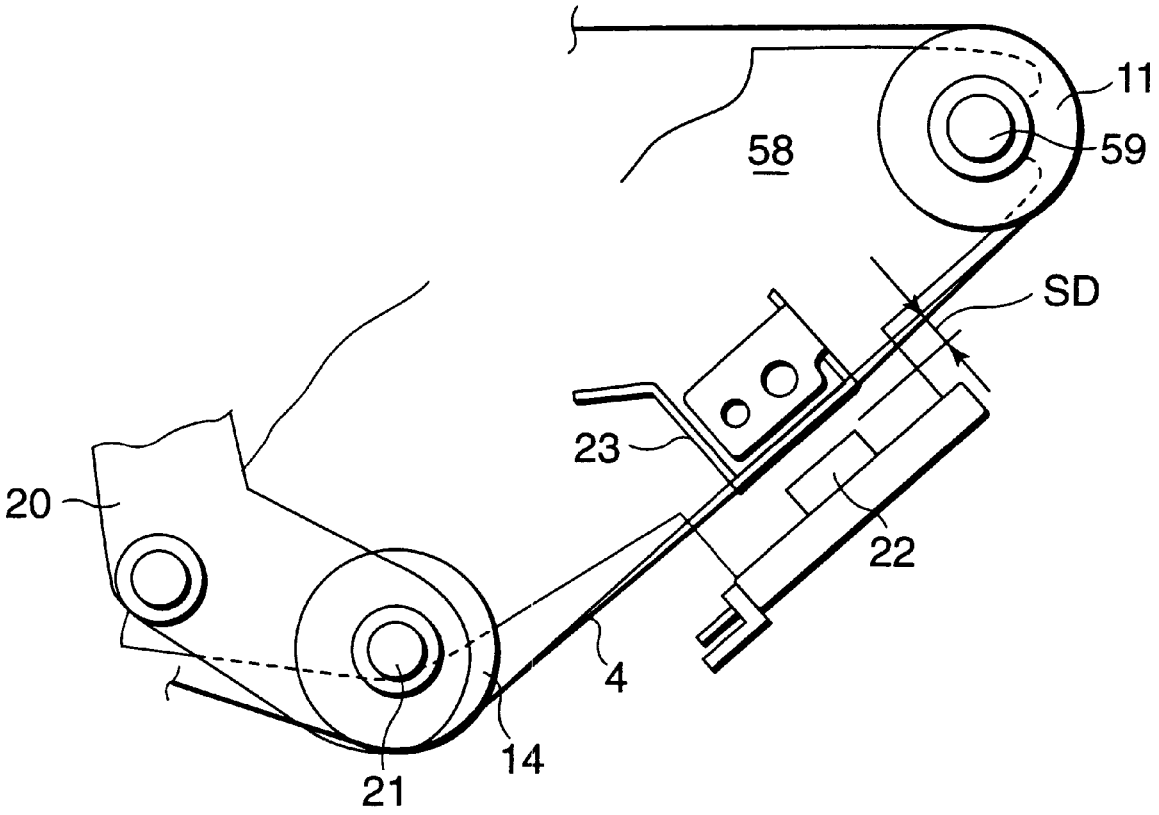
FIG. 15 is an enlarged view showing a mounting structure of a reflection type sensor for sensing a reference position on the intermediate transfer belt in a fifth embodiment of the present invention.

FIG. 15 shows a mounting structure to mount a reflection type sensor for sensing the reference position on the intermediate transfer belt (endless belt) 4. As shown, the drive roll 11 is supported on a shaft 59 which is mounted on a side frame 58 which forms a belt unit. The tension roll 14 is supported on a shaft 21 which is mounted on a bracket 20. The bracket 20 is supported on the side frame 58 in a state that it may be turned within a limited angular range. The intermediate transfer belt 4 passes around various rolls; the drive roll 11, tension roll 14, idle roll 12 and secondary-transfer backup roll 13. The tension roll 14 tightens the belt 4 passing those rolls with a predetermined tension.

A reflection type sensor 22 for sensing a reference position on the intermediate transfer belt 4 is disposed between the drive roll 11 and the tension roll 14. The reflection type sensor 22 is directly mounted on the side frame 58 so as not to vary a distance SD between the sensor and the intermediate transfer belt 4. A backing member 23 is disposed at a location facing the reflection type sensor 22 on the back side (i.e., the side of the inner peripheral surface) of the intermediate transfer belt 4.

Figure 19:
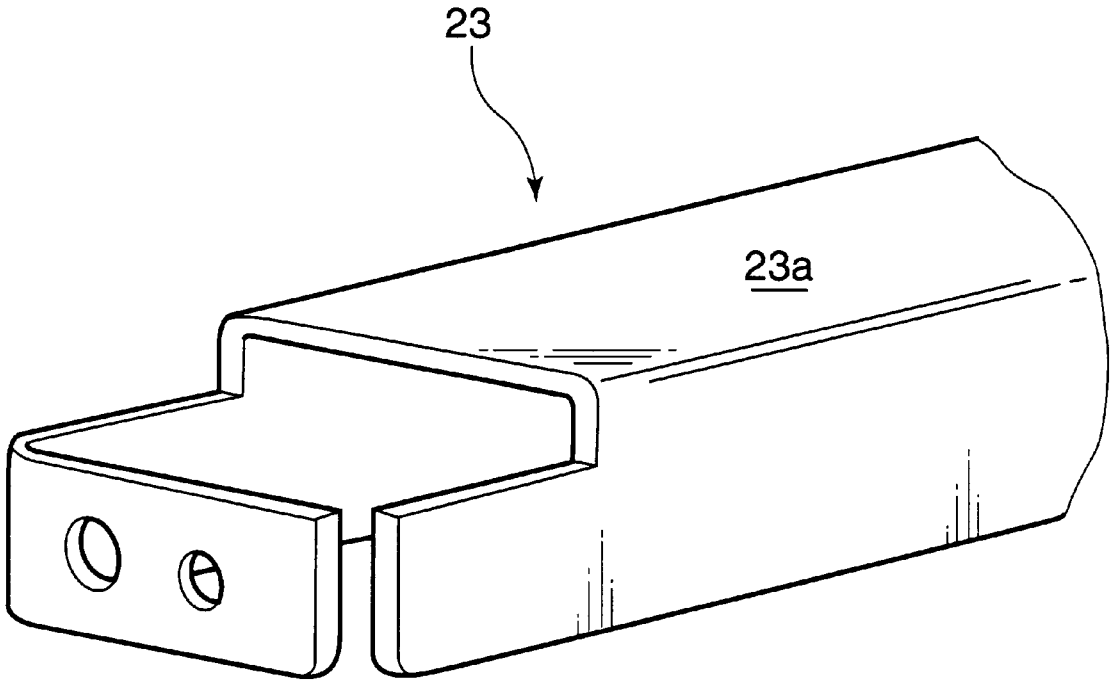
FIG. 19 is a perspective view showing a part of a backing member.
Figure 20:
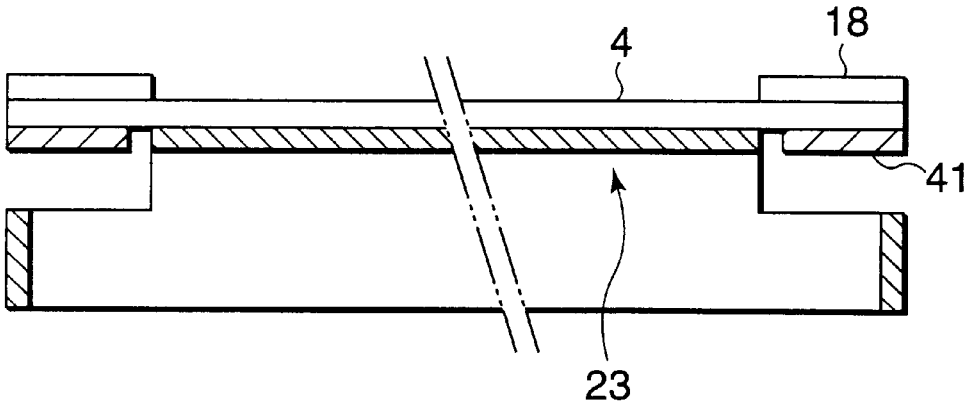
FIG. 20 is a cross sectional view showing the backing member.

FIG. 19 is a perspective view showing a part of the backing member 23, and FIG. 20 is a cross sectional view showing the backing member 23 being in contact with the intermediate transfer belt 4. As shown, the backing member 23 is shaped like a box. A part of each end of the backing member 23 is cut away so as to receive the rib 41. The intermediate transfer belt 4 circulates in a state that the back side of the intermediate transfer belt is in contact with the surface 23*a* of the backing member 23. Therefore, the distance SD between the intermediate transfer belt 4 and the reflection type sensor 22 is kept at a fixed value. To secure a reliable contact of the back side of the intermediate transfer belt 4 with the surface 23*a* of the backing member 23, the backing member 23 is placed at a position slightly deviated to the outer peripheral surface of the intermediate transfer belt 4 from a plane connecting the outer peripheral surface of the drive roll 11 and that of the tension roll 14. In this state, the backing member 23 is mounted on the side frame 58.

For the drive roll 11 and the intermediate transfer belt 4, the fifth embodiment uses the structure shown in FIG. 8. The drive roll 11 includes a roll body 11*a* and a high friction layer 11*b* applied to the surface of the roll body 11*a*. The high friction layer 11*b* is provided for preventing the intermediate transfer belt 4 from slipping on the drive roll 11 also when the cleaner 10 or the secondary transfer roll 6 is loaded on the intermediate transfer belt 4. The roll body 11*a* may be a tube made of aluminum. The high friction layer 11*b* may be a layer, 5 to 50 μm thick, preferably 25 μm thick, made of polyurethane rubber.

A rib guide 17 for guiding a rib 41 is provided at each end of the drive roll 11. The rib guide 17 is made preferably of a resin material, e.g., polyacetal, which provides a smooth surface and a good sliding performance. It is preferable that the rib guide 17 is separated from the side face of the roll body 11*a*. The drive roll 11 is firmly attached to a shaft 11*c*, but the rib guide 17 is preferably rotatable when it receives an external force, independently of the shaft 11*c* and the drive roll 11. The same type of rib guide may be provided on the idle roll 12 and the secondary-transfer backup roll 13 in a similar fashion.

Ribs 41 are bonded on and along the inner sides of the side ends of the intermediate transfer belt 4. Reinforcing tapes 18 as reinforcing means are bonded on and along the outer sides (i.e., the outer peripheral surfaces) of the side ends of the intermediate transfer belt 4. When the ribs pass the rolls, e.g., the drive roll 11, the inner sides of the ribs 41, i.e., the sides thereof closer to the center of the intermediate transfer belt 4 (when viewed in the widthwise direction), slide the ends of the rolls (the rib guides 17 when those guides are used), to thereby limit the axial motions of the rolls (i.e., the motions in the width direction of the intermediate transfer belt 4).

The intermediate transfer belt 4 is a semiconductive film made of polyimide resin which is 50 to 100 μm in thickness and $10^9$ to $10^{12}\Omega\cdot$cm in volume resistivity, and $10^{11}$ to $10^{13}\Omega/\square$ in surface resistivity. The intermediate transfer belt 4 may be made of acrylic resin, vinyl chloride resin or polycarbonate resin containing electric resistance stabilizing agent if it belongs to semiconductive resin material of which the values of the thickness, volume resistivity, and surface resistivity are within the above mentioned ones.

The material of the rib 41 is preferably thermosetting resin, and the rib 41 may be a sheet of polyurethane resin of 0.5 to 1.5 mm thick. The reinforcing tapes 18 may be a polyethylene terephthalate (PET) film of 50 to 100 μm thick.

A reflection tape (not shown) as a mark indicative of an object to be sensed by the reflection type sensor 22, i.e., a position on the intermediate transfer belt 4, is bonded to the reinforcing tape 18. A preferable material for the reflection tape is good in chemical resistance and heat resistance, and hard to generate static electricity.

The distance between the ribs 41 of the intermediate transfer belt 4 and the length of each roll (including the ends of the rib guides 17) have tolerances in their dimension. Therefore, the intermediate transfer belt 4 advances while zigzagging in its width direction within the tolerances. In the event that the rib 41 of the intermediate transfer belt 4 is pressed against the corresponding rib guide 17 through the zig-zag motion, the intermediate transfer belt 4 is deformed at the pressed rib 41 thereof; the side end of the intermediate transfer belt 4 wavily varies in its thickness direction; a distance between the reflection type sensor 22 and the reflection tape (mark) stuck onto the side end of the circulating intermediate transfer belt 4 also varies; and a stable detection of the mark may be lost.

Sensing errors caused by the variation of the distance between the reflection type sensor 22 and the mark, which results from the vibration of the intermediate transfer belt 4, will be described. Sensing errors of the reflection type sensor 22 that spread in the advancing direction of the intermediate transfer belt 4 are as tabulated in FIG. 21. As seen from the table, measurement repetition, power voltage variation and sensing distance determine a total error of sensing. The error that is caused by the distance (sensing distance) between the object to be sensed, or the mark, and the reflection type sensor 22 is 3.8 to 11.6 μm when the vibration of the intermediate transfer belt 4 is 32 μm. These figures of the error are large and this fact indicates that influence of the vibration of the intermediate transfer belt 4 on the total error is great.

Figures 21, 22:
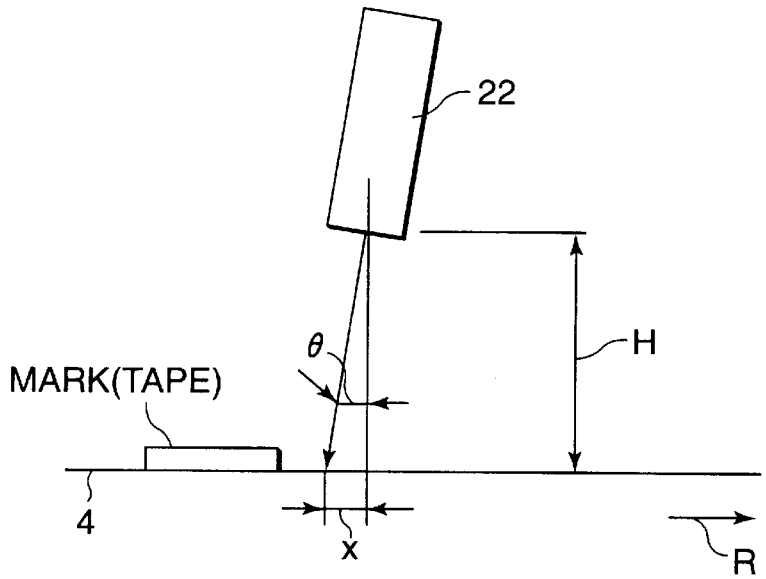
FIG. 21 is a table showing sensing errors of a reflection type sensor.
FIG. 22 is a diagram useful in explaining a sensing error by the reflection type sensor which depends on a mounting accuracy of the sensor.

The sensing error arising from an error of the mounting angle of the reflection type sensor 22 will be described below. Reference is made to FIG. 22. In the figure, H indicates a distance between the tip of the reflection type sensor 22 and the surface of the intermediate transfer belt 4, and θ indicates an angle between the optical axis and the line vertical to the surface of the intermediate transfer belt 4. A sensing error x produced when the intermediate transfer belt 4 vibrates at magnitude of b mm can be mathematically obtained:

Rearranging $X/H=x/h$ for x, then we have $x=h\cdot X/H$ and x (sensing error)$=h\cdot\tan\theta$ (1).

In an example where θ=5° and the intermediate transfer belt 4 vibrates at 0.032 mm, the solution of the equation (1) is 2.8 μm, viz., the sensing error x is 2.8 μm.

The sensing error of the mark caused by the mounting error of the reflection type sensor 22 and the vibration of the intermediate transfer belt 4 straightforwardly appears as a color misregistration. Therefore, it is essential to reduce this error. In this connection, in the present embodiment, the reflection type sensor 22 is fixed to the side frame 58 supporting the intermediate transfer belt 4 to reduce the sensing error, and use of the backing member 23 suppresses the vibration of the intermediate transfer belt 4.

Further, to improve the sensing accuracy of the reflection type sensor 22 by removing the wavy phenomenon of the intermediate transfer belt 4, the embodiment takes the following mechanical measure. The wavy phenomenon occurs at the side end of the intermediate transfer belt 4 that is pressed by the rib guide 17 as stated above. This fact teaches that if the mark is applied onto the side end of the intermediate transfer belt 4 opposite to the pressed side end, the displacement of the intermediate transfer belt 4 in the thickness direction can be removed for the mark. However, only the rib applied onto one of the side ends of the intermediate transfer belt 4 is not always in contact with the end face of the rib guide 17 since the intermediate transfer belt 4 advances while zig-zagging in the belt width direction. To cope with this, the fifth embodiment is arranged such that the intermediate transfer belt 4 is circulated in direction R while being biased to the belt side having a mark attached thereto.

Figure 16:
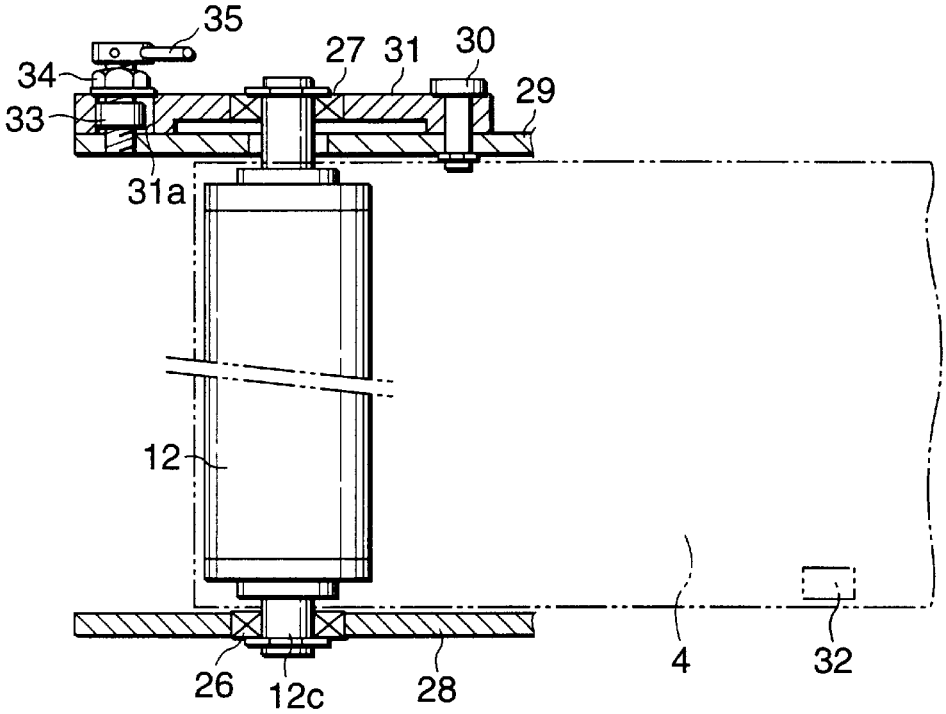
FIG. 16 is a sectional view showing adjusting means for biasing the intermediate transfer belt to one side thereof by shifting the positions of bearings provided at both ends of an idle roll supporting the intermediate transfer belt, one from the other.
Figure 17:
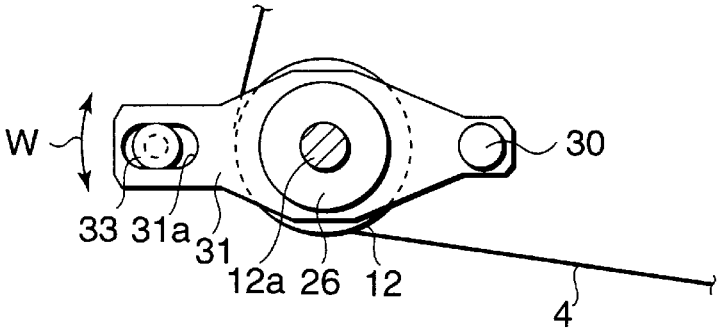
FIG. 17 is a side view showing the adjusting means shown in FIG. 16.

FIG. 16 is a sectional view showing adjusting means for biasing the intermediate transfer belt 4 to one side thereof by shifting the positions of bearings provided at both ends of the idle roll 12 supporting the intermediate transfer belt 4, one from the other. FIG. 17 is a side view showing the adjusting means shown in FIG. 16. As shown, bearings 26 and 27 are provided at both ends of the shaft 12*a* of the idle roll 12, respectively. The bearing 26 is fastened to a front frame 28 of the main body. The bearing 27 is fastened to a plate 31. The plate 31 is supported on a rear frame 29 of the main body which may be turned about a pin 30 within a limited angular range. A mark 32 for position detection is located on the side of the intermediate transfer belt 4 which is closer to the front frame 28.

The limited angular range within which the plate 31 may be turned about the pin 30 is adjusted by means of an eccentric cam 33. Both ends of the shaft of the eccentric cam 33 are threaded. One threaded end of the eccentric cam 33 is screwed into a threaded hole of the rear frame 29. A nut 34 is screwed to the other threaded end of the eccentric cam 33, and a lever 35 is secured to the tip of the other threaded end of the eccentric cam 33.

To adjust the alignment of the idle roll 12, the nut 34 is loosened, and the lever 35 is turned to displace the eccentric cam 33 within an elongated hole 31*a* of the plate 31. As a result, the plate 31 is turned about the pin 30 in one of the directions of arrows w by an angle defined by an amount of eccentricity of the eccentric cam 33 and an amount of rotation of the lever 35. When the amounts of eccentricity of the bearings 26 and 27 reach desired values, the nut 34 is tightened.

When the plate 31 is turned clockwise in FIG. 17, a tension is lessened on the side of the intermediate transfer belt 4, closer to the rear frame 29, and a contact strength acting between the inner peripheral surface of the intermediate transfer belt 4 and the idle roll 12 is lessened on the belt side closer to the rear frame 29. Therefore, the intermediate transfer belt 4 is biased to the side opposite to the rear frame 29, i.e., closer to its mark 32, as it circulates. The result is that the rib 41, which is provided closer to the belt side including the mark 32, is in contact with the end face of the idle roll 12 with a reduced contact force, and the intermediate transfer belt 4 does not vibrate in its thickness direction (viz., its wavy motion does not occur)

The eccentricity amounts of the bearings 26 and 27 are preferably selected to be within a range from 0.1 mm to 0.5 mm for 360 mm of the width of the intermediate transfer belt 4. The reason for this is that where the eccentricity amount is smaller than 0.1 mm, the intermediate transfer belt 4 is insufficiently biased, and when it is 0.5 mm or larger, the intermediate transfer belt 4 is excessively biased, so that a contact force of the rib 41 with the rib guide 17 is too large.

The mechanical arrangement of FIGS. 16 and 17 is used for the belt biasing adjusting purpose in the above instance. The same purpose may also be achieved such that the turning direction of the plate 31 for deviating the center of the bearing 27 from the center of the bearing 26 is turned by 90° in the plane of the rear frame 29. In such an arrangement, the alignment (parallelism) of the idle roll 12 with respect to the drive roll 11 in the belt circulating direction can be adjusted. The result is that a tension is increased in either of the sides of the intermediate transfer belt 4 (viewed in its width direction), and a force to bias the intermediate transfer belt 4 in its direction is generated. The alignment of the idle roll 12 with respect to the drive roll 11 may also be adjusted in such a way that one of the bearings of the tension roll 14, viz., the bearings receiving the ends of the shaft 21 of the tension roll 14, is shifted in the axial center from the other one.

Figure 18:
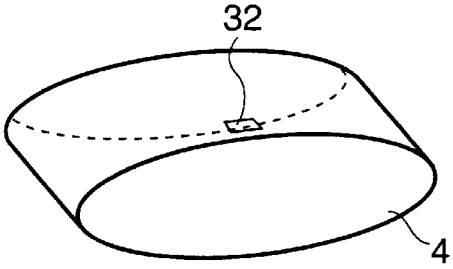
FIG. 18 is a perspective view showing an intermediate transfer belt designed such that the circumferential length of one side of the belt is different from that of the other side.

Further, the intermediate transfer belt 4 may be biased to one of its sides (viewed in its width direction) by use of a belt designed such that the circumferential length of one side of the belt is different from that of the other side. FIG. 18 is a perspective view showing the thus designed intermediate transfer belt 4. The illustrated intermediate transfer belt 4 is formed by molding such that the circumferential length of the belt is gradually decreased from the side including the mark 32 to the opposite side. In the thus configured intermediate transfer belt 4, a tension is great on the side of the belt having the shorter circumferential length, and the belt is biased to the large tension side when it circulates. Also in this case, the contact force of the rib 41 and the rib guide 17 needs to be adjusted so as not to be excessively large. The intermediate transfer belt 4 is molded in such a manner that the material is applied to a mold and rapped. Therefore, it is not difficult to configure the belt such that the circumferential length of one side of the belt is slightly different from that of the other side.

In the alignment of two rolls including the drive roll 11, it is necessary to adjust the contact force of the rib 41 and the rib guide 17 so as not to be excessively large. A deviation of the axis of one roll from that of the other roll is preferably 0.8 mm or smaller when the width of the intermediate transfer belt 4 is 360 mm and the distance between the axes of the two rolls is 190 mm.

While the present invention is applied to a belt apparatus carrying a toner image in the fifth embodiment, the invention may also be applied to another belt apparatus for an image forming apparatus, constructed such that a sheet of recording paper, electrostatically attracted, is transported to contact positions of a plural number of photosensitive members and the belt.

As seen from the foregoing description, the fifth embodiment of the invention succeeds in suppressing a displacement of the mark attached to the intermediate transfer belt in the belt thickness direction. The result is reduction of the detection error caused by the detection distance and angle, exact detection of the reference position on the intermediate transfer belt, and minimization of the picture quality deterioration, e.g., misregistration of colors.

<Sixth Embodiment>

A sixth embodiment of the present invention will be described with reference to FIGS. 23 to 25. In the description of this embodiment, like or equivalent portions are designated by use of like reference numerals used for the description of the fifth embodiment. The description will be given placing emphasis on only the portions not found in the fifth embodiment.

Reference is made to FIG. 23 showing a cross sectional view of an intermediate transfer belt (endless belt) 4 uniquely constructed. As shown, the rib 41 is bonded onto and along the side end of the intermediate transfer belt 4. A belt reinforcing tape 18 as belt reinforcing means is bonded onto and along the outer side (i.e., the outer surface) of the side end of the intermediate transfer belt 4. The inner side faces of the ribs 41, or their faces located closer to the center of the intermediate transfer belt 4 when viewed in its widthwise direction, come in slidable contact with the end faces of the rolls, e.g., the drive roll 11, when those pass the rolls, to thereby limit the motions of the rolls in the axial direction of the rolls.

A reflection tape (not shown) as a mark indicative of a position on the intermediate transfer belt 4 when viewed in the circumferential direction is attached onto the side end of the outer circumferential surface of the intermediate transfer belt 4. A preferable tape for the reflection tape is good in chemical resistance and heat resistance, and generates less static electricity. An example of such a tape is a polyester tape No. 850, silver color, manufactured by Sumitomo 3M Corporation. This No. 850 tape is constructed such that an aluminum-deposited polyester film is used for the base, and a portion on the film is uniformly coated with acrylic adhesive to form an adhesive portion. The physical characteristics of the No. 850 tape are as shown in FIG. 24. The reflection tape is not limited to the No. 850 tape but may be any other tape if it has the physical characteristics comparable with the tabulated ones.

In the sixth embodiment, the reflection type sensor 22 is located downstream of the drive roll 11 when viewed in the circulating direction of the intermediate transfer belt 4, and the primary transfer position or the contact position where the primary transfer roll 5 comes in contact with the photosensitive drum 1 is located upstream of the drive roll 11. Thus, the reflection type sensor 22 is located at a position where the intermediate transfer belt 4 is slack.

In the intermediate transfer belt 4, the tension is varied by various causes, for example, contact and separation between the secondary transfer roll 6 and the cleaner 10, and variation of contact state between the photosensitive drum 1 and the primary transfer roll 5. The tension variation causes the mark to sometimes shift out of its correct position on the intermediate transfer belt 4 in the circulating direction. In particular, at the portion (taut portion) of the intermediate transfer belt 4, located upstream of the drive roll 11, the tension variation is great. At the portion of the intermediate transfer belt 4, located downstream of the drive roll 11, the tension of the belt 4 is stable through the buffering action by the tension roll 14 which elastically tensions the belt.

From this, it is seen that the belt position can accurately be detected in such a manner that the reflection type sensor 22 is located downstream of the drive roll 11, and the mark is read at this position. At this position, there is no chance that the mark is displaced by the tension variation of the intermediate transfer belt 4.

The sixth embodiment takes the following measure to improve the detection accuracy of the reflection type sensor 22. At the completion of the image forming process, the intermediate transfer belt 4 is stopped at such a position that the mark is located at a position out of a lap angle of a roll, e.g., the drive roll 11. If the mark is within the lap angle of the roll, viz., the intermediate transfer belt 4 is stopped at a position within an angle within which the roll is in contact with the belt, the intermediate transfer belt 4 is slightly bent and the bending appears in the form of the displacement of the mark. This adversely affects the detection accuracy of the reflection type sensor 22.

In order that when the intermediate transfer belt 4 is stopped, the mark of the belt is positioned out of the lap angle of the roll, the stopping position of the belt is selected to be a position located upstream of the reflection type sensor 22 but downstream of the drive roll 11, viz., just upstream of the reflection type sensor 22. Such a selection of the stopping position enables the image forming apparatus to enter a first image forming process for a short time after the starting up of the image forming apparatus, as will be described later.

FIG. 25 is a timing chart showing the operations of key portions in the image forming apparatus. An output signal of the reflection type sensor 22, viz., a reference signal indicative of the reference position on the intermediate transfer belt 4, goes positive when the mark is read. This chart shows a time range from the start-up of the apparatus till the intermediate transfer belt 4 enters the fourth circulation thereof. Design is made such that at the stoppage position of the belt, the mark is positioned just before the reflection type sensor 22. Therefore, when the circulation of the intermediate transfer belt 4 commences, the reference signal s1 is immediately output. Upon generation of the reference signal s1, the apparatus may enter the preparatory operation for the image forming process. Before the second circulation of the belt commences, viz., a reference signal s2 is produced, a bias voltage is applied to the charger 2, the charging operation of the photosensitive drum 1 is started, while at the same time the developing unit 3 is turned and a developing bias voltage is applied thereto.

In response to the reference signal s2, an image is written by a laser beam in accordance with image data of the first color (Y), in 50 msec, for example. Incidentally, in response to the reference signal s1, a sheet of recording paper is pulled out of the paper tray 8 and stands by at a preset position just before the secondary transfer position. Subsequently, images of the second to fourth colors are formed, and a composite color image is output. After the secondary transfer is completed, the intermediate transfer belt 4 is stopped after a preset time elapses from the outputting of the final reference signal. The preset time is managed by timer means driven in response to the reference signal. The timer means is set so that the intermediate transfer belt 4 is stopped at such a time point that the mark is positioned immediately after the drive roll 11 but immediately before the reflection type sensor 22.

As seen from the sixth embodiment, there is no chance that the mark indicative of the reference position on the intermediate transfer belt is displaced by the tension variation in the belt caused by an external force applied thereto. Therefore, the reference position can accurately be detected by use of optical detecting means. The result is that the detection error is reduced and the color misregistration is minimized.

What is claimed is:

1. An image forming belt apparatus comprising:

an endless belt;

a plural number of rolls, including at least a drive roll, for supporting said endless belt;

rib members provided on and along both side ends of an inner surface of said endless belt, said rib members being brought into contact with end faces of said rolls to limit a widthwise motion of said endless belt;

a mark formed on one side end of an outer peripheral surface of said endless belt;

sensor means for optically sensing said mark to output a signal indicative of a reference position on said endless belt; and belt biasing means for biasing said endless belt toward a mark-formed side in an axial direction of said rolls.

2. The image forming belt apparatus according to claim 1, wherein said belt biasing means is constructed such that a contact force of at least one of said rolls and the inner peripheral surface of said endless belt is varied in the axial direction of said roll, whereby said endless belt is biased toward a side of said endless belt having a strong contact force.

3. The image forming belt apparatus according to claim 2, wherein a center of one of bearings provided at both ends of said roll is deviated from that of the other bearing.

4. The image forming belt apparatus according to claim 2, wherein said roll of which the contact force is varied in the axial direction is the roll located adjacent to the drive roll.

5. The image forming belt apparatus according to claim 1, further comprising frame means for supporting a belt unit including said endless belt, said sensor means being fastened to said frame means.

6. An image forming belt apparatus comprising:

an endless belt;

a plural number of rolls, including at least a drive roll, for supporting said endless belt;

rib members provided on and along both side ends of an inner surface of said endless belt, said rib members being brought into contact with end faces of said rolls to limit a widthwise motion of said endless belt;

a mark formed on one side end of an outer peripheral surface of said endless belt; and sensor means for optically sensing said mark to output a signal indicative of a reference position on said endless belt, wherein a circumferential length of said endless belt is varied in a widthwise direction of said endless belt to bias said endless belt toward a mark-formed side in an axial direction of said rolls.

7. The image forming belt apparatus according to claim 6, further comprising frame means for supporting a belt unit including said endless belt, said sensor means being fastened to said frame means.

8. An image forming apparatus in which a toner image is primarily transferred from a photosensitive member onto an intermediate transfer belt and the toner image primarily transferred is secondarily transferred onto a recording medium, said image forming apparatus comprising:

a belt support, including a plural number of rolls including at least a drive roll, for supporting and moving said intermediate transfer belt;

a mark indicative of a reference position on said intermediate transfer belt, provided on an outer peripheral surface of said intermediate transfer belt;

a mark detector disposed in a slack portion of said intermediate transfer belt while facing an end of the outer peripheral surface of said intermediate transfer belt to detect the mark; and transfer means disposed in a taut portion of said intermediate transfer belt, wherein one of said plural number of rolls is a tension roll located adjacent to the drive roll, said mark detector is disposed between the drive roll and the tension roll, and further comprising a backing member disposed while facing said mark detector with said intermediate transfer belt located therebetween, and being in contact with a back surface of said intermediate transfer belt.

9. The image forming apparatus according to claim 8, wherein said intermediate transfer belt includes rib members provided on and along both side ends of an inner peripheral surface of said intermediate transfer belt, and said backing member has cut-out portions so as to avoid its interference with the rib members.

* * * * *